US010804632B2

(12) United States Patent
Watanabe

(10) Patent No.: US 10,804,632 B2
(45) Date of Patent: Oct. 13, 2020

(54) CONNECTION TERMINAL AND METHOD FOR PRODUCING CONNECTION TERMINAL

(71) Applicants: AUTONETWORKS TECHNOLOGIES, LTD., Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventor: Hajime Watanabe, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/338,224

(22) PCT Filed: Oct. 6, 2017

(86) PCT No.: PCT/JP2017/036405
§ 371 (c)(1),
(2) Date: Mar. 29, 2019

(87) PCT Pub. No.: WO2018/074255
PCT Pub. Date: Apr. 26, 2018

(65) Prior Publication Data

US 2020/0036125 A1 Jan. 30, 2020

(30) Foreign Application Priority Data

Oct. 20, 2016 (JP) ..... 2016-205742

(51) Int. Cl.
*H01R 13/03* (2006.01)
*C23F 1/00* (2006.01)
(Continued)

(52) U.S. Cl.
CPC ..... *H01R 13/03* (2013.01); *C23F 1/00* (2013.01); *C25D 3/30* (2013.01); *C25D 3/50* (2013.01);
(Continued)

(58) Field of Classification Search
None
See application file for complete search history.

(56) References Cited

U.S. PATENT DOCUMENTS 9,728,878 B2 * 8/2017 Shibuya ..... C25D 5/12
2008/0188100 A1 * 8/2008 Saitoh ..... H01R 12/585 439/82
(Continued)

FOREIGN PATENT DOCUMENTS

WO 2013/168764 A1 11/2013
WO 2015/068572 A1 5/2015
WO 2015/151959 A1 10/2015

OTHER PUBLICATIONS

Dec. 12, 2017 International Search Report issued in International Patent Application PCT/JP2017/036405.

*Primary Examiner* — Xuong M Chung Trans
(74) *Attorney, Agent, or Firm* — Oliff PLC

(57) ABSTRACT

A connection terminal in which alloy particles made of an intermetallic compound containing tin and palladium are exposed on an outermost surface of a contact configured to electrically contact a mating conductor and distributed on a surface of a base material at least in the contact, wherein: a tin part made of pure tin or an alloy having a higher ratio of tin to palladium than the intermetallic compound is not
(Continued)

exposed on a plane passing through a point where a height of the alloy particles from the surface of the base material is highest.

11 Claims, 7 Drawing Sheets

(51) Int. Cl.

| | |
|---|---|
| ***C25D 3/30*** | (2006.01) |
| ***C25D 3/50*** | (2006.01) |
| ***C25D 5/10*** | (2006.01) |
| ***C25D 5/48*** | (2006.01) |
| ***C25D 7/00*** | (2006.01) |
| ***H01B 1/02*** | (2006.01) |
| ***H01R 43/16*** | (2006.01) |

(52) U.S. Cl.
CPC ..... *C25D 5/10* (2013.01); *C25D 5/48* (2013.01); *C25D 7/00* (2013.01); *H01B 1/02* (2013.01); *H01R 43/16* (2013.01)

(56) References Cited

U.S. PATENT DOCUMENTS

| | | | | |
|---|---|---|---|---|
| 2012/0107639 | A1* | 5/2012 | Takamizawa ..... | C25D 5/10 428/620 |
| 2015/0133005 | A1 | 5/2015 | Saka et al. | |
| 2016/0240950 | A1 | 8/2016 | Watanabe et al. | |
| 2017/0033486 | A1 | 2/2017 | Saka et al. | |

* cited by examiner 1.0at%

2.0at%

3.5at%

5.0at%

7.0at%

CONNECTION TERMINAL AND METHOD FOR PRODUCING CONNECTION TERMINAL

This application is the U.S. National Phase of PCT/JP2017/036405 filed Oct. 6, 2017, which claims priority to JP 2016-205742 filed Oct. 20, 2016, the entire disclosure of which is incorporated herein by reference.

BACKGROUND

The present disclosure relates to a connection terminal and a method for producing a connection terminal, more particularly to a connection terminal in which an alloy is exposed on a surface and a method for producing such a connection terminal.

Conventionally, a material having tin plating applied to a surface of a backing material such as copper or copper alloy has been generally used as a material constituting a connection terminal. In a tin plating layer, an insulating tin oxide film is formed on a surface. However, since the tin oxide film is destroyed with weak force, metal tin is easily exposed and a good electrical contact is formed on the surface of the soft metal tin.

For example, Japanese Unexamined Patent Publication No. 2003-147579 discloses a terminal formed by successively laminating a nickel plating layer, a copper plating layer and a tin plating layer at least on a surface of a contact portion with a mating member, out of a backing material made of copper alloy. In this terminal, the nickel plating layer is provided to suppress the diffusion of copper in the backing material to the tin plating layer, and the copper plating layer is provided to suppress the production of an intermetallic compound of nickel and tin. Further, a terminal insertion force is reduced by limiting a thickness of the tin plating layer.

SUMMARY

If a tin layer is exposed on an outermost surface of a contact portion as in the terminal disclosed in Japanese Unexamined Patent Publication No. 2003-147579, the excavation of the tin layer or the adhesion of tin occurs due to the softness of tin, whereby a friction coefficient increases. As a result, a terminal insertion force increases. Particularly, in a multi-polar connector with many terminals, an increase of the insertion force becomes more problematic. Although the friction coefficient can be suppressed low to a certain extent by limiting the thickness of the tin layer as described in Japanese Unexamined Patent Publication No. 2003-147579, it is difficult to drastically reduce the friction coefficient as long as the tin layer is exposed on the outermost surface of the contact portion.

Further, the tin layer easily forms an intermetallic compound with another metal layer by mutual diffusion and a surface state largely changes over time when the tin layer is heated. If such an intermetallic compound is oxidized on the outermost surface of the contact portion, the contact resistance of the contact portion may be increased. As described in Japanese Unexamined Patent Publication No. 2003-147579, it is possible to suppress the diffusion of the other metal to the tin layer and the formation of the intermetallic compound with tin by the selection of a metal layer provided as a layer below the tin layer. However, if the terminal is exposed in a high-temperature environment for a long time, the formation of the intermetallic compound with tin possibly becomes non-negligible.

An exemplary aspect of the disclosure provides a connection terminal capable of reducing a friction coefficient and suppressing a change over time at high temperature while maintaining connection reliability as compared to connection terminals in which tin is exposed on an outermost surface of a contact portion, and a method for producing such a connection terminal.

A connection terminal according to the present disclosure is such that alloy particles made of an intermetallic compound containing tin and palladium are exposed on an outermost surface of a contact configured to electrically contact a mating conductor and distributed on a surface of a base material at least in the contact, wherein a tin part made of pure tin or an alloy having a higher ratio of tin to palladium than the intermetallic compound is not exposed on a plane passing through a point where a height of the alloy particles from the surface of the base material is highest.

Here, the tin part may not be present around the alloy particles. Further, the surface of the base material may be exposed between the alloy particles.

The base material may include a layer of nickel or nickel alloy, and the intermetallic compound may have a composition of $(Ni_{0.4}Pd_{0.6})Sn_4$.

A ratio of an area occupied by the alloy particles in the contact may be 30% or higher.

An average thickness of a layer occupied by the alloy particles may be 0.1 μm or larger and 5.0 μm or smaller.

A method for producing a connection terminal according to the present disclosure includes fabricating a laminated structure in which a palladium layer and a tin layer are laminated in this order on a surface of a base material, heating the laminated structure to form alloy particles made of an intermetallic compound containing tin and palladium, and removing a tin part made of pure tin or an alloy having a higher ratio of tin to palladium than the intermetallic compound, the pure tin or the alloy deriving from excess tin having not formed the intermetallic compound.

Here, removing the tin part may be performed by chemically dissolving tin.

A ratio of palladium to the total amount of tin and palladium in the laminated structure may be 2 atom % or higher. Further, the ratio of palladium to the total amount of tin and palladium in the laminated structure may be below 20 atom %.

In the connection terminal according to the above disclosure, excavation and adhesion hardly occur and a low friction coefficient is obtained in the contact since the intermetallic compound containing tin and palladium and constituting the alloy particles exposed on the outermost surface has a high hardness. In addition, since tin that increases the friction coefficient is not exposed on the plane passing through a position where the height of the alloy particles is highest, a terminal insertion force for the connection terminal can be suppressed low.

Simultaneously, the intermetallic compound containing tin and palladium has a high conductivity and is hardly oxidized. Thus, a low contact resistance is obtained on the surface of the contact. As a result, high connection reliability can be achieved.

Since the intermetallic compound containing tin and palladium has already formed a stable intermetallic compound, the intermetallic compound hardly changes over time such as alloying with other metals even when being heated. Since tin that easily forms intermetallic compounds with other metals due to a change over time is not exposed on the plane passing through the position where the height of the alloy particles is highest, the contact resistance hardly increases due to a change over time on the entire outermost surface of the contact. Thus, high connection reliability can be maintained in the long term.

Here, if the tin part is not present around the alloy particles, tin is not present in an entire part in contact with the alloy particles, including the plane passing through the position where the height of the alloy particles is highest. Thus, the surface of the contact is hardly affected by a change of tin over time and long-term connection reliability of the connection terminal can be obtained.

Further, if the surface of the base material is exposed between the alloy particles, tin is not present also in parts between the alloy particles. Thus, long-term connection reliability of the connection terminal is further enhanced.

If the base material includes a layer of nickel or nickel alloy and the intermetallic compound has a composition of $(Ni_{0.4}Pd_{0.6})Sn_4$, the diffusion of metal atoms from a backing material made of copper or the like can be suppressed by the layer made of nickel or nickel alloy. Thus, a situation where the contact resistance of the outermost surface increases due to such diffusion of metal atoms can be suppressed even if the base material is heated at high temperature for a long time.

If the ratio of the area occupied by the alloy particles in the contact is 30% or higher, a contact area between the contact of the connection terminal and the mating conductive member is secured, whereby the contact resistance can be particularly suppressed small.

If a dynamic friction coefficient between the contact and the mating conductive member having a tin layer exposed on an outermost surface is 0.4 or lower, the terminal insertion force can be sufficiently suppressed low.

If the average thickness of the layer occupied by the alloy particles is 0.1 μm or larger and 5.0 μm or smaller, an effect of reducing the friction coefficient and suppressing the change over time by the alloy particles can be sufficiently enjoyed.

According to the method for producing a connection terminal according to the present disclosure, a structure in which alloy particles made of an intermetallic compound containing tin and palladium are exposed on an outermost surface and a tin part is not exposed on a plane passing through a point where a height of the alloy particles is highest as described above can be easily formed on a surface of a connection terminal.

Here, if the step of removing the tin part is performed by chemically dissolving tin, the removal of the tin part can be easily accomplished in a state with a small abundance. As a result, the effect of reducing the friction coefficient and suppressing a change over time by the alloy particles can be notably obtained in the produced connection terminal.

If the ratio of palladium to the total amount of tin and palladium in the laminated structure is 2 atom % or higher, the friction coefficient can be effectively reduced in the contact of the produced connection terminal by securing the area of the alloy particles exposed on the outermost surface.

Further, if the ratio of palladium to the total amount of tin and palladium in the laminated structure is below 20 atom %, a state where excess tin and the alloy particles coexist is easily reached when the laminated structure is heated, and the intermetallic compound exposed on the outermost surface after the removal of tin tends to be in form of a particle aggregate.

DETAILED DESCRIPTION OF EMBODIMENTS

Hereinafter, a connection terminal and a producing method thereof according to one embodiment of the present disclosure are described in detail using the drawings. In the connection terminal according to the one embodiment of the present disclosure, at least a contact portion configured to electrically contact a mating conductive member such as a mating terminal is made of a terminal material 1 having an alloy particle layer 20 to be described below on a surface. The connection terminal made of such a terminal material 1 can be produced by the method for producing a connection terminal according to the one embodiment of the present disclosure.

[Structure of Terminal Material]

Figure 1:
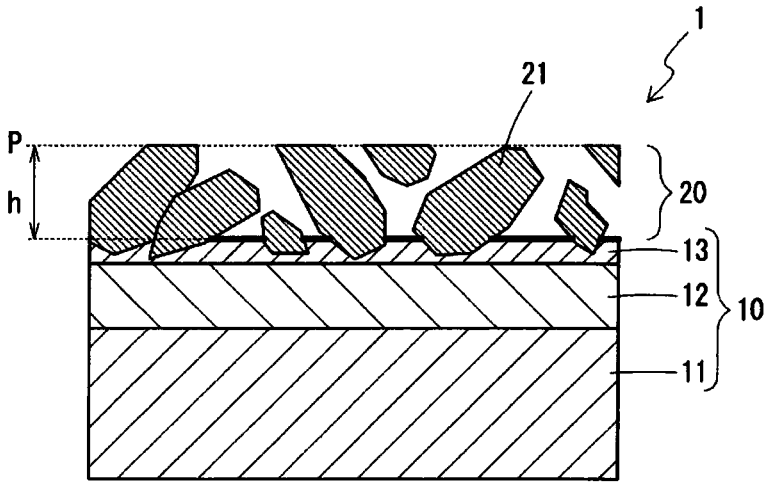
FIG. 1 is a section showing a terminal material constituting a connection terminal according to one embodiment of the present disclosure.

The terminal material 1 constituting the connection terminal has a layer structure whose cross-section is schematically shown in FIG. 1. That is, the alloy particle layer 20 is formed on the surface of a base material 10. The alloy particle layer 20 is exposed on an outermost surface of the terminal material 1.

The base material 10 mainly contains a plate-like backing material 11. The backing material 11 is, for example, copper, aluminum, iron or an alloy mainly containing one of these metals. Out of these, copper or copper alloy generally used as a backing material of connection terminals is particularly preferable since having a high conductivity.

The base material 10 can be composed only of the backing material 11, but a metal coating layer may be appropriately provided on a surface of the backing material 11 to form the base material 10. In this embodiment, an underlayer 12 made of nickel or nickel alloy is formed to cover the surface of the backing material 11. The underlayer 12 functions to hold the alloy particle layer 20 in closer contact with the backing material 11 and suppress the diffusion of metal atoms such as copper atoms from the backing material 11 to the alloy particle layer 20.

A part of the underlayer 12 on the side of the alloy particle layer 20 may become a nickel-tin alloy layer 13 by heating in a step of forming the alloy particle layer 20. The nickel-tin alloy layer 13 has a composition of $Ni_3Sn_4$. By forming the nickel-tin alloy layer 13, the diffusion of metal atoms from the backing material 11 to the alloy particle layer 20 is firmly suppressed even at high temperature.

The alloy particle layer 20 is an aggregate of alloy particles 21. The alloy particles 21 are made of an intermetallic compound (tin-palladium based alloy) containing tin and palladium. The intermetallic compound may be a binary alloy composed only of tin and palladium or a multi-component alloy containing other metal(s) besides tin and palladium. In the case of the binary alloy, the intermetallic compound has a composition of $PdSn_4$. Examples of metal elements constituting the multi-component alloy other than tin and palladium include metal elements contained in the base material 10. In the case of providing the underlayer 12 made of nickel or nickel alloy on the surface of the base material 10 as described above, a ternary alloy having a composition of $(Ni_{0.4}Pd_{0.6})Sn_4$ tends to be formed. Note that, regardless of whether the intermetallic compound is the binary alloy or the multi-component alloy, the alloy particles 21 may contain a small amount of metal elements constituting the base material 10, unavoidable impurities, phases of palladium not taken into the alloy and the like in addition to the intermetallic compound.

In the alloy particle layer 20, each alloy particle 21 is bonded to the base material 10. Particularly, when the underlayer 12 made of nickel or nickel alloy is formed on the surface of the base material 10 and a part thereof becomes the nickel-tin alloy layer 13, partial regions of the alloy particles 21 on the side of the base material 10 are fit in the nickel-tin alloy layer 13 and surrounded by a nickel-tin alloy.

Here, an outermost surface P, which is a virtual plane passing through a point where a height h of the alloy particles 21 from the surface of the base material 10 is highest is assumed. In the alloy particle layer 20, a tin part made of pure tin or an alloy having a higher ratio of tin than in the intermetallic compound constituting the alloy particles 21 is not exposed on the outermost surface P.

The tin part may be present in gaps or the like between the alloy particles 21 in the alloy particle layer 20 unless being exposed on the outermost surface P. Preferably, as shown in FIG. 1, the tin part is not present around each alloy particle 21, i.e. at positions in contact with the alloy particles 21. Further, it is desirable that the tin part is not present in the alloy particle layer 20, i.e. on the surface of the base material 10 except for tin unavoidably remaining without being removed in a manufacturing process to be described later. Besides the tin part, metals other than the tin-palladium based alloy constituting the alloy particles 21 except metals constituting the base material 10 are preferably not present around the alloy particles 21.

In a state shown in FIG. 1, no tin part is present around the alloy particles 21, whereby the surface of the base material 10, here, the surface of the nickel-tin alloy layer 13 is exposed in the gaps between the alloy particles 21 as shown by thick lines in FIG. 1. Note that if the density of the alloy particles 21 is high, the entire surface of the base material 10 may be covered by the alloy particles 21 and the surface of the base material 10 may be hardly exposed.

In the alloy particle layer 20, the size and density of the alloy particles 21 are not particularly limited. However, an average thickness of the alloy particle layer 20 is preferably 0.1 μm or larger. In this way, properties exhibited by the alloy particles 21 such as a reduction of the friction coefficient and the suppression of a change over time described later can be sufficiently utilized. On the other hand, the average thickness of the alloy particle layer 20 is preferably 5.0 μm or smaller. This is because the properties exhibited by the alloy particles 21 are saturated and material cost required to form the alloy particles 21 increases if the alloy particle layer 20 is formed too thick. Here, the average thickness of the alloy particle layer 20 indicates a thickness of a film uniformly covering the surface of the base material 10 converted from an abundance of the tin-palladium based alloy in the form of the alloy particles 21.

[Characteristics of Terminal Material]

(Friction Coefficient)

As described above, the terminal material 1 includes the alloy particle layer 20, in which the alloy particles 21 made of the tin-palladium based alloy are exposed on the outermost surface, on the surface of the base material 10. The tin-palladium based alloy has a high hardness. Thus, the excavation and adhesion of surface metal, which often occur on a surface of a tin layer, hardly occur on the surface of the alloy particle layer 20. In this way, the alloy particles 21 provide a lower friction coefficient than tin on the surface of the terminal material 1. Further, since the tin part is not exposed on the outermost surface P in the alloy particle layer 20, a situation where the friction coefficient of the alloy particle layer 20 increases due to the contribution of the tin part does not occur and a low friction coefficient provided by the alloy particles 21 can be directly utilized as the friction coefficient of the entire alloy particle layer 20. As a result, the friction coefficient on the surface of the entire alloy particle layer 20 is lower than on the surface of the tin layer. Furthermore, in the above terminal material 1, some of the alloy particles 21 are fit into the nickel-tin alloy layer 13 and firmly bonded to the base material 10, whereby the exfoliation of the alloy particles 21 by friction is suppressed, which also contributes to a reduction of the friction coefficient.

For example, in the case of using a member, in which a tin layer is exposed on an outermost surface (tin plating layer), as a mating conductive member, a dynamic friction coefficient between the terminal material 1 and the mating conductive member can be set to be 0.4 or lower. By suppressing the friction coefficient of the surface of the terminal material 1 low in this way, an insertion force for the connection terminal can be suppressed low. Particularly, in the case of constituting a multi-polar connector using a multitude of connection terminals, an insertion force increases as the number of the connection terminals increases. Thus, an effect of reducing the insertion force by using the above terminal material 1 can be largely enjoyed.

(Contact Resistance)

Further, the tin-palladium based alloy has a high conductivity and is hardly oxidized. Thus, a low contact resistance is obtained on the surface of the alloy particle layer 20. That contact resistance is larger than that of a material having a tin plating layer formed on a surface, but can be suppressed sufficiently low and, for example, can be suppressed to 1 mΩ or lower similarly to the tin plating layer. By suppressing the contact resistance of the surface of the terminal material 1 low in this way, a good electrical contact is formed on the contact portion of the connection terminal and high connection reliability is obtained.

The contact resistance on the surface of the alloy particle layer 20 becomes smaller as a substantial contact area with the mating conductive member becomes larger. Thus, as the amount of exposure of the alloy particles 21 on the outermost surface P increases, the contact resistance can be made smaller. For example, the alloy particle layer 20 may be formed such that a ratio of an area (area ratio) of the alloy particles 21 occupying the surface of the base material 10 exceeds 15%. More preferably, that area ratio may be set to 30% or higher. The area ratio can be evaluated by calculating a ratio of an area of the alloy particles 21 occupying an entire viewing region in an observed image by a microscope such as a scanning electron microscope.

Note that although the aggregate of the alloy particles 21 made of tin-palladium based alloy is exposed on the outermost surface in this terminal material 1, it is also supposed to provide a tin-palladium based alloy layer as a smooth continuous body instead. Actually, in the case of forming a tin-palladium based alloy by heating a laminated structure of a palladium layer and a tin layer as described later, such smooth laminar tin-palladium based alloy can be formed by adjusting a thickness ratio of the tin layer and the palladium layer and a heating condition so that excess tin does not remain. However, in such a case, a very thin layer of tin oxide unavoidably remains on a surface of the laminar tin-palladium based alloy. Then, that layer of tin oxide increases contact resistance on the surface. For this reason, it is better to provide the alloy particle layer 20 as the aggregate of the alloy particles 21 than to provide the smooth tin-palladium based alloy layer.

(Change Over Time by Heating)

Further, the alloy particles 21 have already formed a stable intermetallic compound and hardly form intermetallic compounds by mutual diffusion with other metals present in the surrounding such as the metals constituting the base material 10. Thus, even if the terminal material 1 is heated for a long time due to a surrounding environment or energization, the alloy particle layer 20 hardly changes over time due to the formation of the intermetallic compounds with the other metals. If the alloy particle layer 20 forms an intermetallic compound with another metal, the formed intermetallic compound may be possibly oxidized on the outermost surface of the terminal material 1 to increase the contact resistance. However, in this terminal material 1, such a situation hardly occurs and a state where connection reliability is high can be maintained in the long term due to the stability of the tin-palladium based alloy.

If the tin part is exposed on the outermost surface P in the alloy particle layer 20, tin tends to form intermetallic compounds with metals such as nickel. Thus, when the terminal material 1 is heated for a long time, the tin part possibly forms an intermetallic compound by mutual diffusion with the metal constituting the base material 10 such as nickel in the underlayer 12 and the nickel-tin alloy layer 13. If that intermetallic compound is oxidized on the outermost surface of the terminal contact portion, it can lead to an increase of the contact resistance. However, since the tin part is not exposed on the outermost surface P of the alloy particle layer 20 in the above terminal material 1, such a situation can be avoided and high connection reliability can be ensured over a long period of time. Particularly, a reduction in connection reliability by heating can be further reliably avoided unless the tin part is substantially present not only on the outermost surface P, but also in the alloy particle layer 20 including the surroundings of the alloy particles 21.

For example, an increase rate of the contact resistance from a value before heating when the terminal material 1 is heated at 160° C. can be suppressed to 10% or lower, further 5% or lower. 120 hours or a time longer than that can be illustrated as a heating time for evaluating an increase of the contact resistance.

[Producing Method of Terminal Material]

The terminal material 1 described above can be produced, for example, by the following method.

In producing the above terminal material 1, the base material 10 is first prepared. For example, the underlayer 12 may be formed on the surface of the backing material 11 by plating or the like. The palladium layer and the tin layer are laminated in this order on the surface of the obtained base material 10 by plating or the like to form the laminated structure.

Subsequently, this laminated structure is heated. By heating, alloying between the tin layer and the palladium layer proceeds and the alloy particles 21 made of the intermetallic compound containing tin and palladium are formed. Simultaneously, a part of the underlayer 12 made of nickel or nickel alloy forms an intermetallic compound with the tin layer of the laminated structure, thereby becoming the nickel-tin alloy layer 13.

Figure 2:
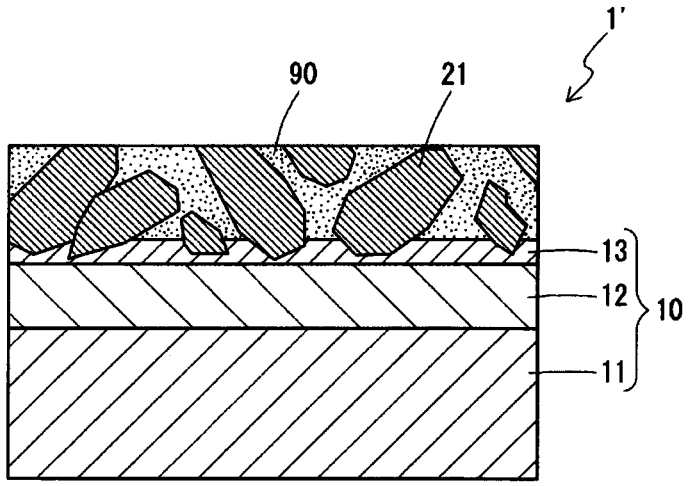
FIG. 2 is a section showing a state of a precursor before the removal of a tin part in a method for producing a connection terminal according to the one embodiment of the present disclosure.

After heating, a precursor 1' as shown in FIG. 2 is obtained. In the precursor 1', a layer composed of the alloy particles 21 made of the intermetallic compound containing tin and palladium and a tin part 90 is formed on the surface of the base material 10. The tin part 90 is made of pure tin or an alloy having a higher ratio of tin than the intermetallic compound constituting the alloy particles 21. The tin part 90 derives from excess tin having not formed the intermetallic compound during heating. In the precursor 1', both the tin part 90 and the alloy particles 21 are exposed on the outermost surface.

Subsequently, the terminal material 1 in which the alloy particles 21 are exposed and the tin part 90 is not exposed on the outermost surface as shown in FIG. 1 can be obtained by at least partially removing the tin part 90 from the precursor 1'. At this time, it is preferable to remove all the tin part 90 except tin that unavoidably remains.

The tin part 90 can be easily and effectively removed by chemically dissolving tin. For example, tin can be selectively dissolved without almost changing the alloy particles 21 if a mixed aqueous solution of sodium hydroxide and p-nitrophenol is used.

In forming the laminated structure of the palladium layer and the tin layer, the average thickness of the alloy particle layer 20 and the area ratio of the alloy particles 21 in the terminal material 1 to be produced can be controlled by selecting the thicknesses of the palladium layer and the tin layer. At this time, a ratio of palladium to the total amount of tin and palladium (Pd/(Sn+Pd)) is preferably set to 2 atom % or higher. In this way, after heating, the terminal material 1 is easily obtained in which the area ratio of the alloy particles 21 in an SEM image is 30% or higher and which provides a low contact resistance.

On the other hand, the ratio of palladium in the laminated structure is preferably set below 20 atom %. As described above, the stable composition of the binary alloy between tin and palladium is $PdSn_4$. By setting the ratio of palladium below 20 atom %, a state where particulate tin-palladium alloy is diffused in the excess tin part 90 is easily set after heating. By removing the tin part 90 in this state, the tin-palladium alloy is easily obtained not in the form of a smooth layer, but in the form of an aggregate of the alloy particles 21. Note that if the alloy particles 21 are made of multi-component alloy, it is even better to determine an upper limit for the ratio of palladium in consideration of the composition of that multi-component alloy so that that excess tin part 90 remains during heating.

[Structure of Connection Terminal]

The connection terminal according to the one embodiment of the present disclosure may be of any type and shape as long as at least the contact portion configured to contact the mating conductive member is made of the terminal material 1 as described above.

Figure 3:
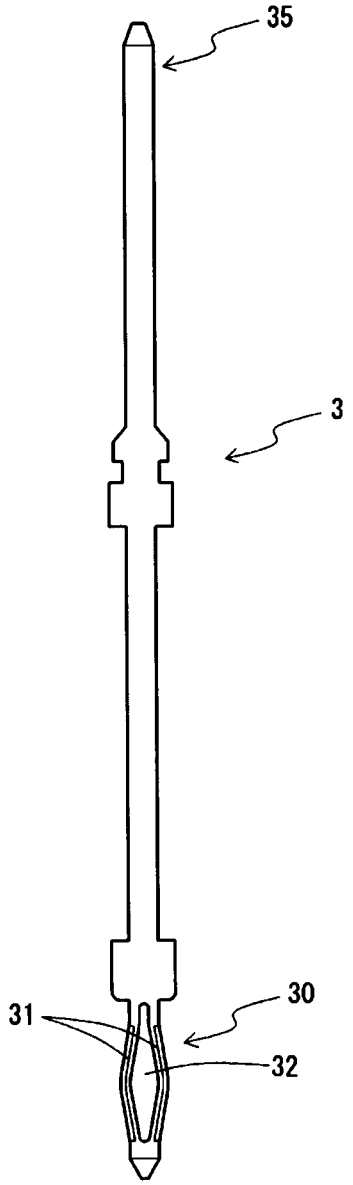
FIG. 3 is a front view showing a press-fit terminal as an example of the connection terminal, FIG. 4 show surface SEM images of an alloy particle exposed sample of Example 1, wherein (a) shows a state before tin was removed, (b) shows a state after tin was removed and (c) shows a state after the sample was further left at high temperature.

A press-fit terminal 3 as shown in FIG. 3 can be illustrated as an example of the connection terminal. The press-fit terminal 3 is an electrical connection terminal shaped to be long and narrow, and includes a board connecting portion 30 to be press-fit and connected to a through hole of a board on one end and a terminal connecting portion 35 to be connected to a mating connection terminal by fitting or the like on the other end. In the shown example, the terminal connecting portion 35 is shaped as a male fitting terminal.

The board connecting portion 30 includes a pair of bulging pieces 31, 31 in a part to be press-fit and connected to the through hole 30. The bulging pieces 31, 31 are shaped to substantially arcuately bulge out away from each other in directions perpendicular to an axial direction of the press-fit terminal 3. A gap 32 is formed between the pair of bulging pieces 31, 31. By the presence of this gap 32, the pair of bulging pieces 31, 31 are pressed to be compressed toward each other and resiliently deformed when the press-fit terminal 3 is inserted into the through hole. The bulging pieces 31, 31 are resiliently restored and kept in electrical contact with the inner peripheral surface of the through hole. A multitude of the press-fit terminals 3 can be held side by side and used as a multi-polar board connector.

In the press-fit terminal 3, the alloy particle layer 20 is appropriately formed together with the underlayer 12 at least on surfaces of the bulging pieces 31, 31 and the terminal connecting portion 35 serving as contact portions configured to electrically contact mating conductive members (inner peripheral surface of the through hole and the mating connection terminal) to obtain a state equivalent to the above terminal material 1. In terms of production convenience, the entire press-fit terminal 3 may be formed of the above terminal material 1.

EXAMPLES

Example and Comparative Example of the present disclosure are described below. Note that the present disclosure is not limited by the following Example.

[Fabrication of Samples]

Example 1

An alloy particle exposed sample according to Example 1 was fabricated as follows. That is, a nickel under-plating layer having a thickness of 1.0 was formed on a clean surface of a copper backing material and a palladium plating layer having a thickness of 0.02 μm was formed on the nickel under-plating layer. Subsequently, a tin plating layer having a thickness of 1.0 μm was formed on the palladium plating layer. This laminated structure was heated at 300° C. in the atmosphere, whereby the alloying of the tin plating layer and the palladium plating layer proceeded. Thereafter, the sample was immersed in a mixed aqueous solution of sodium hydroxide and p-nitrophenol to remove an excess tin part. A surface and a cross-section of the obtained sample were SEM-observed to confirm a state.

Comparative Example 1

A tin plated sample according to Comparative Example 1 was fabricated as follows. That is, a tin plating layer having a thickness of 1.0 μm was formed on a surface of a copper backing material formed with a nickel under-plating layer similar to the above one. Then, this laminated structure was heated at 300° C. in the atmosphere, thereby applying a reflow process.

[Testing Method]

(Evaluation of Contact Resistance)

Contact resistance was evaluated by measuring a load-contact resistance characteristic (F-R characteristic) for the samples of Example 1 and Comparative Example 1. First, an embossed contact point having R=1.0 mm and made of a tin plated material similar to that of Comparative Example 1 and flat plate-like contact points formed of the respective samples of Example 1 and Comparative Example 1 were prepared as electrodes. A top part of the embossed contact point was brought into contact with a surface of the flat plate-like contact point, and contact resistance between the both contact points was measured by a four terminal method while a load was applied in a contacting direction. In measuring, an open voltage was set at 20 mV, an energizing current was set at 10 mA and a load applying speed was set at 0.1 mm/min and a load of 0 to 40N was applied in an increasing direction and a decreasing direction.

(Evaluation of Friction Coefficient)

Dynamic friction coefficients were measured for three types of samples, i.e. the samples of Example 1 and Comparative Example 1 and the sample before removing the tin part (precursor) in Example 1. Specifically, the flat plate-like contact points were first formed using the respective samples. Further, using the tin plated material similar to that of Comparative Example 1, a semispherical embossed contact point having R=3.0 mm was formed. Then, the embossed contact point was held vertically in contact with the flat plate-like contact point and slid in a horizontal direction at a speed of 10 mm/min while a load of 5 N was applied in the vertical direction, and a dynamic friction force was measured using a load cell. A value obtained by dividing the dynamic friction force by the load was set as the dynamic friction coefficient. A sliding movement was made over a distance of 5 mm.

(Evaluation of High-Temperature Durability)

The samples of Example 1 and Comparative Example 1 were held at 160° C. in the atmosphere for 120 hours (hereinafter, this condition is referred to as "left at high temperature" in some cases). After being left at high temperature, the sample of Example 1 was SEM-observed. Further, for the samples of Example 1 and Comparative Example 1, the load-contact resistance characteristic was measured in the same manner as the measurement for the samples before being left at high temperature as described above after the samples were cooled to room temperature.

(Evaluation of Relationship Between Ratio of Palladium and Contact Resistance)

A relationship between the ratio of palladium in the laminated structure before heating and the contact resistance of the terminal material after heating and tin removal was evaluated. That is, a plurality of samples were fabricated by changing the thickness of the palladium plating layer in the laminated structure before heating on the basis of the sample Example 1. Using those samples, the SEM observation and the load-contact resistance measurement were conducted in the same manner as for the sample of Example 1. Then, the contact resistances at a load of 10 N were compared. Note that the ratio of palladium in the laminated structure (Pd/(Sn+Pd)) was 3.5 atom % in the sample of Example 1.

[Test Results]

(Evaluation of States of Samples)

Figure 4A:
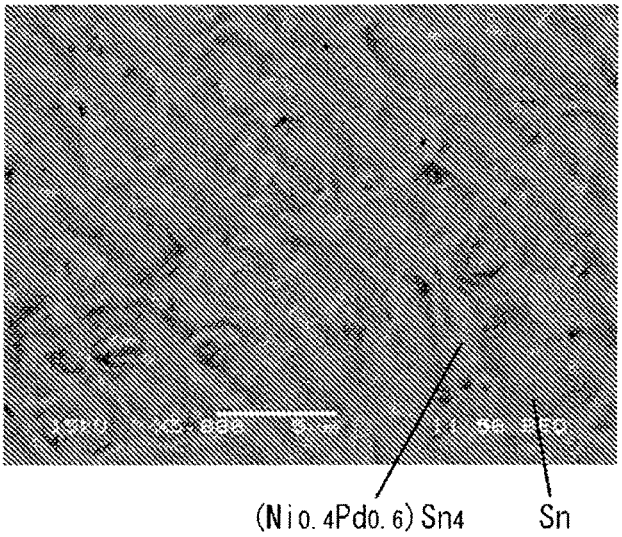
Figure 4B:
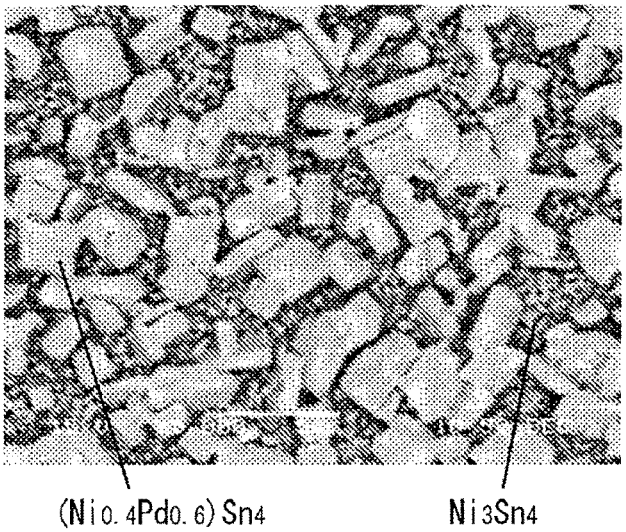
Figure 4C:
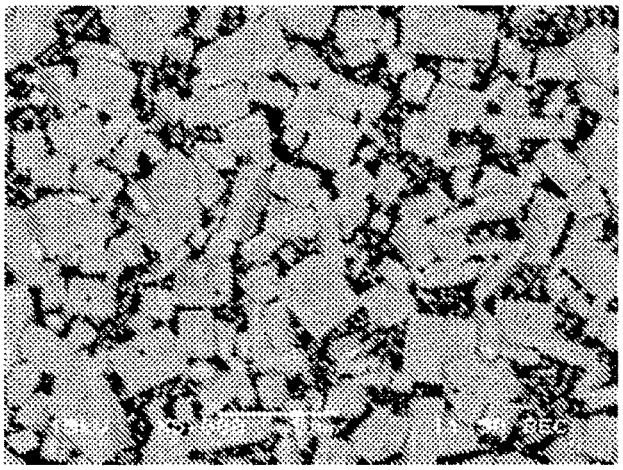

FIGS. 4(*a*) and 4(*b*) show surface SEM images before and after tin removal for the alloy particle exposed sample of Example 1. Before tin removal of FIG. 4(*a*), both alloy particles made of tin-palladium based alloy ($(Ni_{0.4}Pd_{0.6})Sn_4$; the same applies hereinafter) and in a sea-island state and a tin part surrounding the alloy particles are exposed on a surface. In contrast, after tin removal of FIG. 4(*b*), no structure observed in gray having a medium brightness and equivalent to the tin part is seen around the alloy particles made of tin-palladium based alloy. Instead, a nickel-tin alloy layer ($Ni_3Sn_4$) observed to be dark is seen around the alloy particles.

Figure 5:
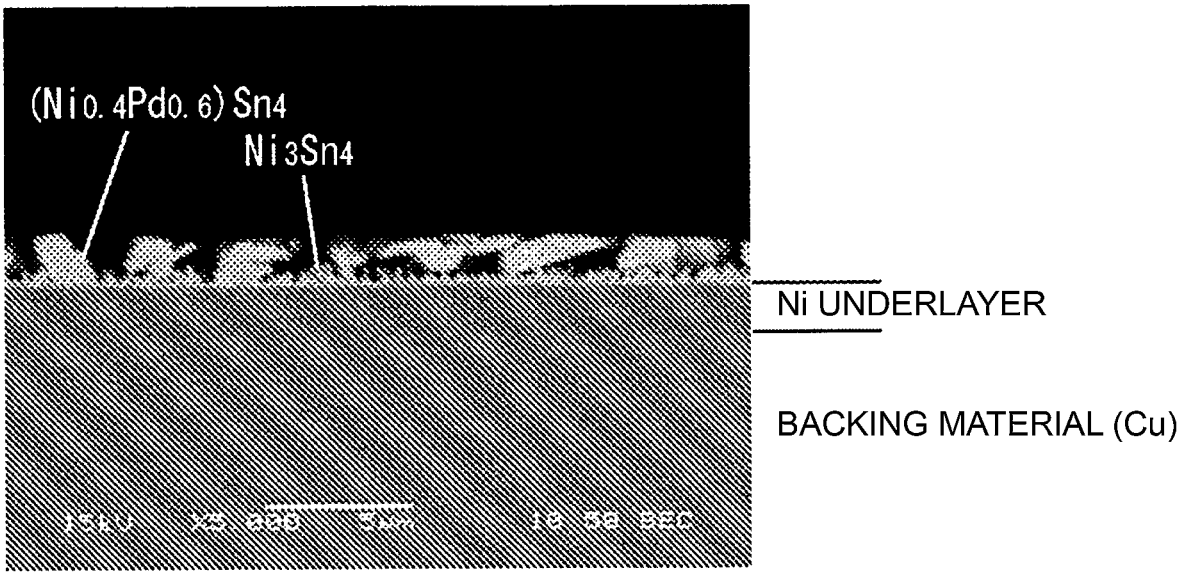
FIG. 5 shows an SEM image of a sample cross-section in a state after tin was removed, FIG. 6 are graphs showing load-contact resistance characteristics, wherein (a) is a result for the alloy particle exposed sample of Example 1 having tin removed therefrom, (b) is a result for a tin plated sample of Comparative Examine 1 and a measurement result after the sample was left at high temperature is also shown in (a), FIG. 7 are graphs showing friction coefficient evaluation results, wherein (a) is the result for the alloy particle exposed sample of Example 1 having tin removed therefrom, (b) is the result for the sample before tin was removed in Example 1, and (c) is the result for the tin plated sample of Comparative Examine 1, and FIG. 8 are SEM images of surfaces of alloy particle exposed samples obtained by changing a ratio of palladium in a lamination structure before alloying, wherein the ratio of palladium increases in the order of (a) to (e).

FIG. 5 shows an SEM image of a cross-section of the sample after tin removal. Also in the cross-section, it is observed that parts of the nickel underlayer serve as the nickel-tin alloy layer and the alloy particles made of tin-palladium based alloy are exposed on an outermost surface. No tin part is present in gaps between the alloy particles. Note that, in the surface image and the cross-section image, a metal composition of each part is confirmed by element analysis (EDX) by X-ray spectrometry.

From the above surface and cross-section SEM images, it was confirmed that the alloy particles made of tin-palladium based alloy were exposed and distributed on the outermost surface in the alloy particle exposed sample of Example 1 after tin removal. Further, it was confirmed that tin was not exposed not only on the outermost surface passing through the position where the height of the alloy particles is highest, but also around the alloy particles at least in a level distinguishable by the SEM.

(Evaluation of Contact Resistance)

Figure 6A:
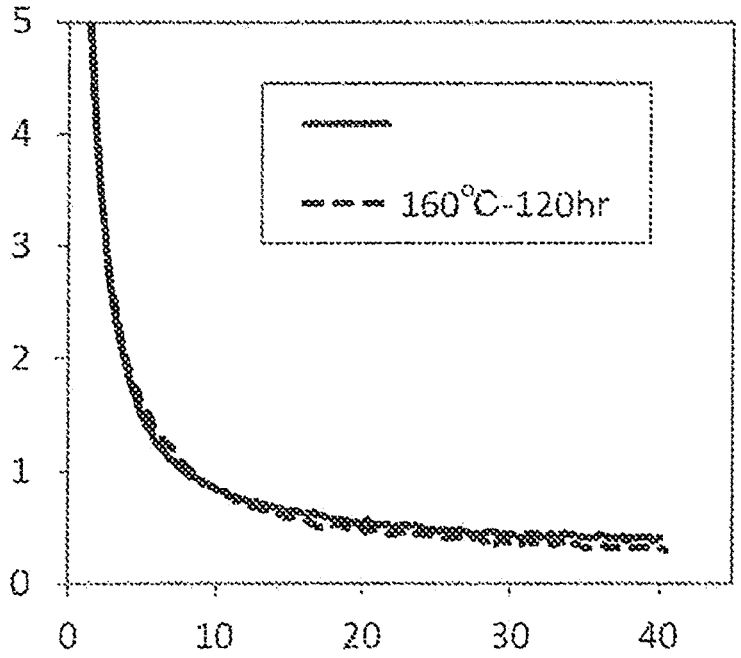
Figure 6B:
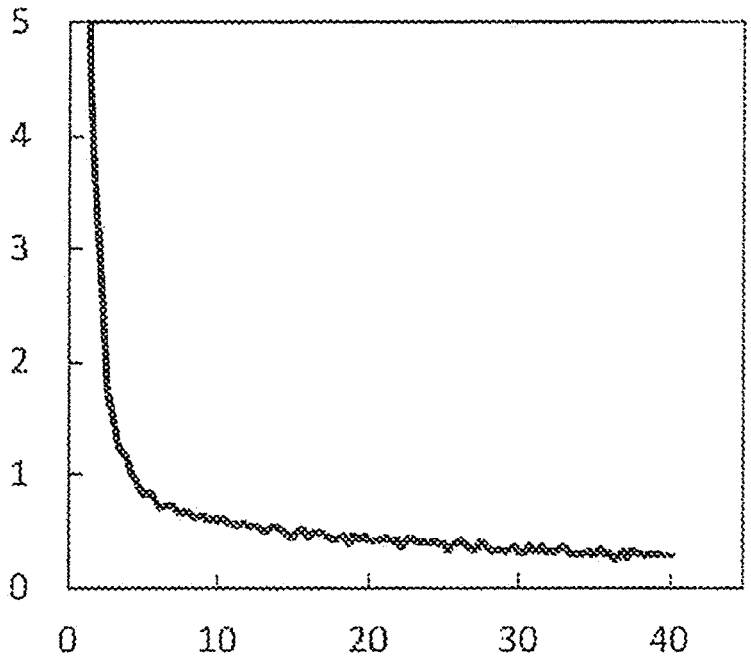

The load-contact resistance characteristic of the alloy particle exposed sample after tin removal of Example 1 is shown by a solid line in FIG. 6(*a*). Further, the load-contact resistance characteristic of the tin plated sample of Comparative Example 1 is shown in FIG. 6(*b*). The comparison of the both characteristics find that the tin plated sample shows a low contact resistance, but the contact resistance of the alloy particle exposed sample is also suppressed substantially within twice the contact resistance of the tin plated sample. For example, as shown in Table 2 below, the contact resistance of the alloy particle exposed sample at a load of 10 N is suppressed to 1.7-fold of that of the tin plated sample. Such contact resistance of the alloy particle exposed sample is sufficiently low when being used as a connection terminal.

(Evaluation of Friction Coefficient)

Figure 7A:
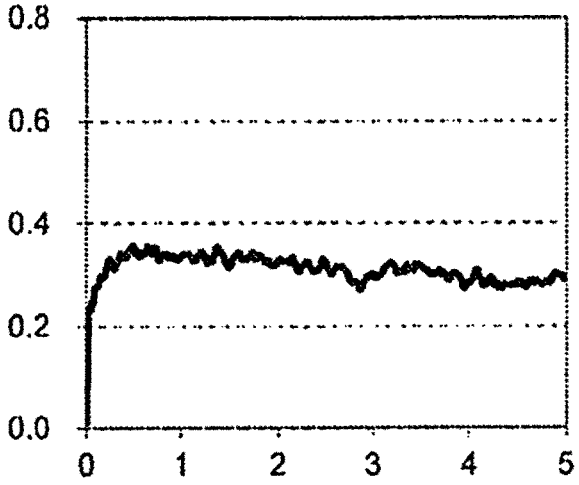
Figure 7B:
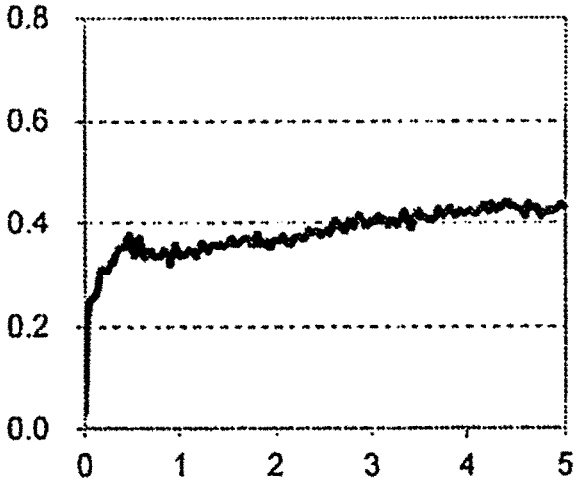
Figure 7C:
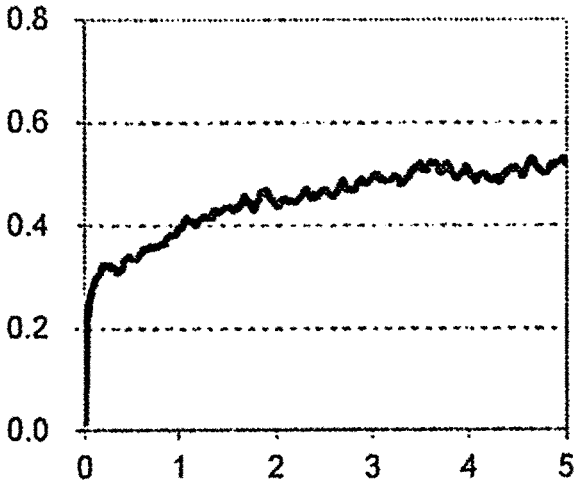

FIG. 7 show friction coefficient measurement results of (a) the alloy particle exposed sample after tin removal (Example 1), (b) the alloy particle exposed sample before tin removal and (c) the tin plated sample (Comparative Example 1). Further, Table 1 show maximum values of the friction coefficients. Together, reductions of the friction coefficients from the value of the tin plated sample are shown for the alloy particle exposed samples.

TABLE 1

| | Alloy Particle Exposed Samples | | |
|---|---|---|---|
| | After Sn Removal | Before Sn Removal | Tin Plated Sample |
| Friction Coefficient | 0.36 | 0.44 | 0.53 |
| Reduction Effect | 32% | 17% | — |

According to FIG. 7 and the results of Table 1, the alloy particle exposed sample has a lower friction coefficient than the tin plated sample even before tin removal since the hard tin-palladium based alloy is exposed on the outermost surface. The friction coefficient is further drastically reduced by removing tin. This is interpreted as a result of the removal of tin, which increases the friction coefficient on the surface due to excavation and adhesion, from the surface and the exposure of only the hard alloy particles providing a low friction coefficient on the outermost surface.

(Evaluation of High-Temperature Durability)

FIG. 4(*c*) shows an SEM image of the surface of the alloy particle exposed sample of Example 1 having tin removed therefrom after being left at high temperature. In comparison to the SEM image of FIG. 4(*b*) before being left at high temperature, no large change is seen in the shapes, sizes and distributed state of the alloy particles. That is, the state of the surface can be said to have hardly changed even after being left at high temperature.

Further, the measurement result of the load-contact resistance characteristic before being left at high temperature is shown by a solid line and the measurement result after being left at high temperature is shown by a broken line for the alloy particle exposed sample of Example 1 having tin removed therefrom in FIG. 6(*a*). The both curves substantially overlap and it is understood that the contact resistance has hardly changed even after being left at high temperature.

Further, Table 2 summarizes the values of the contact resistance before and after being left at high temperature at a load of 10 N and change amounts for the alloy particle exposed sample of Example 1 after tin removal and the tin plated sample of comparative Example 1.

TABLE 2

| | Contact Resistance [mΩ] | | | |
|---|---|---|---|---|
| | Initial | After Left at H-Temp | Resistance Increase After Being Left at H-Temp [mΩ] | Resistance Increase Rate After Being Left at H-Temp |
| Alloy Particle Exposed Sample | 0.86 | 0.88 | +0.02 | +2% |
| Tin Plated Sample | 0.52 | 1.42 | +0.90 | +173% |

According to Table 2, the contact resistance of the tin plated sample has increased by more than 100% by being left at high temperature. This corresponds to the fact that alloying proceeds between tin and the nickel underlayer and the produced alloy is oxidized on the outermost surface. On the other hand, a resistance increase rate of the alloy particle exposed sample is suppressed to as low as 2% as also seen in the result of FIG. 6(*a*). This is interpreted as a result of the removal of tin, which is easily alloyed with nickel and the like, from the surface and the exposure of only the alloy particles made of tin-palladium based alloy, which is hardly alloyed with other metals even at high temperature, on the surface.

(Evaluation of Relationship Between Ratio of Palladium and Contract Resistance)

Figure 8:
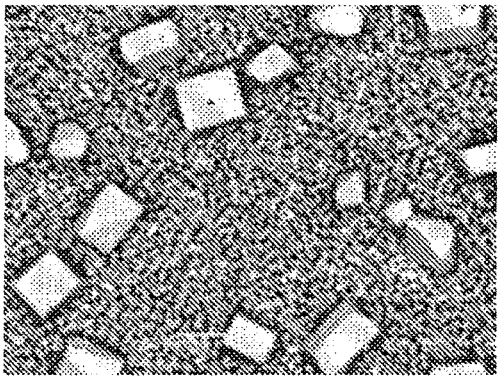
Figure 8:
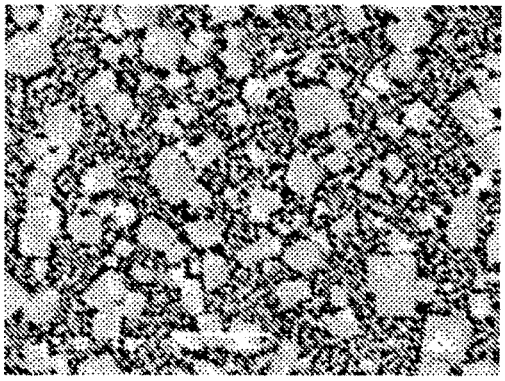
Figure 8:
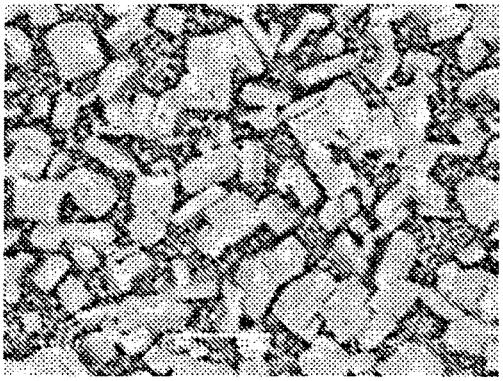
Figure 8:
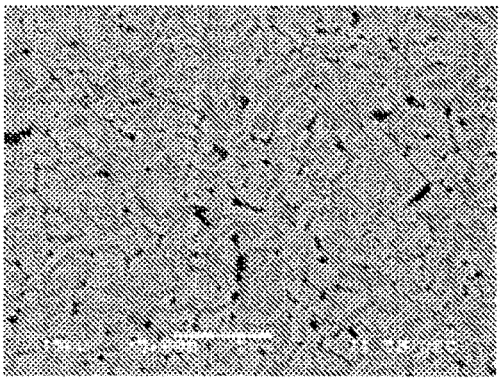
Figure 8:
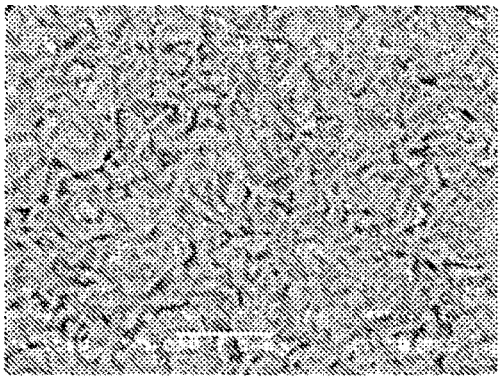

FIG. 8 show surface SEM images of the alloy particle exposed sample obtained in the case of variously changing the ratio of palladium in the laminated structure before heating. The contents of palladium in the laminated structures before heating are shown in FIG. 8. According to FIG. 8, it is understood that as the ratio of palladium is increased, the ratio of the alloy particles observed in bright gray increases. Particularly, in a region where the ratio of palladium is 5.0 atom % or higher, the area of a region where the alloy particles covers the sample surface suddenly increases.

A relationship of the ratio of palladium in the laminated structure before heating, an area ratio of the region occupied by the alloy particles obtained by image analysis of the SEM image and the contact resistance at 10 N (measured only for three samples) is summarized in Table 3 below.

TABLE 3

| Pd Ratio Before Heating | 1.0 at % | 2.0 at % | 3.5 at % | 5.0 at % | 7.0 at % |
|---|---|---|---|---|---|
| Area Ratio of Alloy | 15% | 35% | 52% | 94% | About 100% |
| Contact Resistance | 5.4 mΩ | 1.1 mΩ | 0.86 mΩ | | |

It is also understood from Table 3 that the area ratio of the alloy increases as the ratio of palladium before heating is increased and the area ratio of the alloy suddenly increases in the region where the ratio of palladium is 5.0 atom % or higher as also seen in FIG. 8. Further, as the area ratio of the alloy increases together with the ratio of palladium before heating, the contact resistance is reduced. Particularly, in a region where the ratio of palladium is 2.0 atom % at which the area ratio of the alloy is 30% or higher, the contact resistance is suddenly reduced. A reduction of the contact resistance is interpreted as a result of an increase of the area ratio of the region occupied by the alloy particles and contact with the mating conductive member in a large area due to an increase of the ratio of palladium.

Although the embodiment of the present disclosure has been described in detail above, the present disclosure is not limited to the above embodiment at all and various changes can be made without departing from the gist of the present disclosure. For example, the tin part may not be completely removed and, rather, partly left by adjusting the concentration of the mixed aqueous solution of sodium hydroxide and p-nitrophenol, an immersion time and the like in removing the tin part.

The invention claimed is:

1. A connection terminal in which alloy particles made of an intermetallic compound containing tin and palladium are exposed on an outermost surface of a contact configured to electrically contact a mating conductor and distributed on a surface of a base material at least in the contact, wherein:

a tin part made of pure tin or an alloy having a higher ratio of tin to palladium than the intermetallic compound is not exposed on a plane passing through a point where a height of the alloy particles from the surface of the base material is highest.

2. A connection terminal according to claim 1, wherein the tin part is not present around the alloy particles.

3. A connection terminal according to claim 1, wherein the surface of the base material is exposed between the alloy particles.

4. A connection terminal according to claim 1, wherein:

the base material includes a layer of nickel or nickel alloy; and the intermetallic compound has a composition of $(Ni_{0.4}Pd_{0.6})Sn_4$.

5. A connection terminal according to claim 1, wherein a ratio of an area occupied by the alloy particles in the contact is 30% or higher.

6. A connection terminal according to claim 1, wherein a dynamic friction coefficient between the contact and the mating conductor having a tin layer exposed on an outermost surface is 0.4 or lower.

7. A connection terminal according to claim 1, wherein an average thickness of a layer occupied by the alloy particles is 0.1 μm or larger and 5.0 μm or smaller.

8. A method for producing a connection terminal, comprising:

fabricating a laminated structure in which a palladium layer and a tin layer are laminated in this order on a surface of a base material;

heating the laminated structure to form alloy particles made of an intermetallic compound containing tin and palladium; and removing a tin part made of pure tin or an alloy having a higher ratio of tin to palladium than the intermetallic compound, the pure tin or the alloy deriving from excess tin having not formed the intermetallic compound.

9. A method for producing a connection terminal according to claim 8, wherein removing the tin part is performed by chemically dissolving tin.

10. A method for producing a connection terminal according to claim 8, wherein a ratio of palladium to the total amount of tin and palladium in the laminated structure is 2 atom % or higher.

11. A method for producing a connection terminal according to claim 8, wherein a ratio of palladium to the total amount of tin and palladium in the laminated structure is below 20 atom %.

* * * * *